US007541886B2

(12) United States Patent
Yoneyama et al.

(10) Patent No.: US 7,541,886 B2
(45) Date of Patent: Jun. 2, 2009

(54) NRD GUIDE TRANSITION, AND COUPLING STRUCTURE OF DIELECTRIC MATERIAL AND CONDUCTOR

(75) Inventors: Tsukasa Yoneyama, Sendai (JP); Futoshi Kuroki, Kure (JP); Hirokazu Sawada, Sendai (JP)

(73) Assignee: Intelligent Cosmos Research Institute, Sendai-Shi (JP)

( * ) Notice: Subject to any disclaimer, the term of this patent is extended or adjusted under 35 U.S.C. 154(b) by 259 days.

(21) Appl. No.: 10/556,911

(22) PCT Filed: May 17, 2004

(86) PCT No.: PCT/JP2004/006973

§ 371 (c)(1),
(2), (4) Date: Jul. 13, 2006

(87) PCT Pub. No.: WO2004/102725

PCT Pub. Date: Nov. 25, 2004

(65) Prior Publication Data

US 2007/0040629 A1 Feb. 22, 2007

(30) Foreign Application Priority Data

May 16, 2003 (JP) ..... 2003-139558
Sep. 19, 2003 (JP) ..... 2003-328017

(51) Int. Cl.
*H01P 5/103* (2006.01)
*H01P 5/107* (2006.01)

(52) U.S. Cl. ..... 333/26; 333/248

(58) Field of Classification Search ..... 333/26, 333/248

See application file for complete search history.

(56) References Cited

U.S. PATENT DOCUMENTS 6,538,530 B2 * 3/2003 Kii et al. ..... 333/137

(Continued)

FOREIGN PATENT DOCUMENTS

JP 11-31548 2/1999

(Continued)

OTHER PUBLICATIONS

Taishi Kuroki, Tsunehito Kimura, Koichi Yamaoka, Tsutomu Yoneyama, "NRD Guide-Suichoku Strip Senro Henkanki o Mochiita 60GHz Tai T-bunki", 2002 Nen The Institute of Electronics, Information and Communication Engineers Electronics Society Taikai, C-2-39, 2002.

(Continued)

*Primary Examiner*—Benny Lee
(74) *Attorney, Agent, or Firm*—Young & Thompson

(57) ABSTRACT

In order to realize with a low loss a hybrid structure in which an NRD guide is used for a transmission part and a microstrip line is used for a circuit element loading part, the present device includes: a dielectric waveguide (1) which is sandwiched between parallel conductor plates and has a gap which is less than a ½ wavelength; a microstrip line (4) which is provided on a side surface of a metal rod (3) opposite to the dielectric waveguide (1), the metal rod (3) being adjacently arranged in parallel with the dielectric waveguide (1); and a coaxial line (5) which pierces the metal rod (3) and connects the dielectric waveguide (1) with the microstrip line (4).

6 Claims, 14 Drawing Sheets

U.S. PATENT DOCUMENTS 6,882,253 B2 * 4/2005 Okamura et al. ..... 333/239

FOREIGN PATENT DOCUMENTS

| | | |
|---|---|---|
| JP | 11-74708 | 3/1999 |
| JP | 11-195444 | 7/1999 |
| JP | 2000-278006 | 10/2000 |
| JP | 2001-7613 | 1/2001 |
| JP | 2001-160703 | 6/2001 |
| JP | 2001-217332 | 8/2001 |
| JP | 2002-290102 | 10/2002 |

OTHER PUBLICATIONS

Taishi Kuroki, Tsunehito Kimura, Koichi Yamaoka, Tsutomu Yoneyama, "NRD Guide-Suichoku Strip Senro Henkanki o Mochiita 60GHz Tai T-bunki Kairo", 2003 Nen The Institute of Electronics, Information and Communication Engineers Sogo Taikai, C-2-62, Mar. 3, 2003.

Hirokazu Sawada, Tsutomu Yoneyama, Taishi Kuroki, "Atarashii NRD Guidebend", 2003 Nen The Institute of Electronics, Information and Communication Engineers Electronics Society Taikai, C-2-64, Sep. 10, 2003.

Hirokazu Sawada, Tsutomu Yoneyama, Taishi Kuroki, "NRD Guidebend Seigoki", The Institute of Electronics, Information and Communication Engineers Gijutsu Hokoku (Shingaku Giho), MW2003-33, May 16, 2003.

* cited by examiner

DIELECTRIC WAVEGUIDE RELATIVE DIELECTRIC CONSTANT: 2.04
HEIGHT: 2.25 mm
WIDTH: 2.5 mm

NRD GUIDE TRANSITION, AND COUPLING STRUCTURE OF DIELECTRIC MATERIAL AND CONDUCTOR

TECHNICAL FIELD

The present invention relates to an NRD guide transition which connects an NRD guide (Nonradiative Dielectric Waveguide) having a very small transmission loss with a microstrip line capable of flexibly constituting various kinds of circuits, and a coupling structure of a general dielectric material and a conductor including coupling of the dielectric waveguide and a conductor or coupling of a dielectric material and a conductor in coupling of a microstrip line and a coaxial line.

BACKGROUND ART

In recent years, realization of ultrahigh-speed/high-capacity wireless communication has come into great demand, and utilization of a millimeter wave band is useful for realization of this type of communication. In particular, development of a broadband circuit element, which does not require a license and covers a 59- to 66-GHz band, is important. With this development, it is possible to realize an ultrahigh-speed wireless LAN, a home link, TV indoor wireless transfer, an inter-vehicle communication system and others at a transmission rate exceeding, e.g., 400 Mbps.

As such, an NRD guide has been conventionally used as a millimeter-wave or microwave transmission circuit. In this NRD guide, as shown in FIG. 11, a dielectric waveguide 101 formed of, e.g., polytetrafluoroethylene, better known as TEFLON®, having, e.g., a dielectric constant $\in r=2.04$, is provided between a pair of parallel conductor plates 102*a* and 102*b*. A width of each of these conductor plates 102*a* and 102*b*, i.e., a height of the dielectric waveguide 101, is set to be less than a ½ wavelength of a frequency of a millimeter wave, and a width of the dielectric waveguide 101 is set to be approximately ½ wavelength. For example, if an operating frequency is 60 GHz, a height of the dielectric waveguide 101 is set to 2.25 mm and a width of the dielectric waveguide 101 is set to 2.5 mm. As a result, a millimeter wave having the operating frequency can be propagated through the dielectric waveguide 101, but the millimeter wave having the operating frequency cannot be propagated outside the dielectric waveguide 101, and hence the millimeter wave is trapped in and transmitted through the dielectric waveguide 101.

Although such an electric field in a cross section as shown in FIG. 11 is generated in an operating mode (an LSM mode) of the millimeter wave transmitted through this dielectric waveguide, an LSE mode which is an unnecessary parasitic mode is produced as shown in FIG. 12 when the dielectric waveguide 101 bends or branches between the pair of conductor plates 102*a* and 102*b*.

In order to suppress this LSE mode, a mode suppressor 103 having a ¼ wavelength choke structure is inserted into the dielectric waveguide 101 in the prior art as shown in FIG. 15 (see Japanese Patent Application Laid-open No. 2000-341003).

However, inserting the above described conventional mode suppressor 103 into the dielectric waveguide 101, there arises a problem that requires a troublesome operation involving time and labor; namely, the dielectric waveguide 101 must be cut open in a longitudinal direction, and the mode suppressor 103 is inserted into and attached to this cut portion. Thus, the present inventors have discovered that arranging a conductor in the vicinity of or in close contact with the dielectric waveguide 101 can effectively control the LSE mode, which is a parasitic mode (see Japanese Patent Application No. 2003-49953).

However, where the dielectric waveguide 101 is brought into contact with the conductor, there is a problem wherein transmission characteristics may not be obtained as designed, and irregularities in the transmission characteristics become substantial.

In a circuit using an NRD guide, a microstrip line may be used in some cases, where coupling the NRD guide with the microstrip line through a coaxial line can reduce deterioration in the transmission characteristics. However, there is a problem that the transmission characteristics may not be obtained as designed in coupling the microstrip line and the coaxial line, and irregularities in the transmission characteristics again become substantial.

The NRD guide has excellent characteristics wherein transmission loss is very low in a millimeter-wave band as described above and radiation of an unnecessary millimeter wave is not generated at all in a bent part or a discontinuous part of the dielectric waveguide. The NRD guide is suitable for loading a two-terminal element such as a diode, but has a problem that it is not suitable for loading a three-terminal element.

On the other hand, the microstrip line is suitable for loading of a three-terminal element or the like, and can constitute various kinds of flexible circuits. However, the microstrip line has a problem that it demonstrates a large transmission loss in a millimeter-wave band.

Thus, there can be considered a hybrid structure in which the NRD guide is used for a transmission part and the microstrip line is used for a circuit element loading part, such as a three terminal element. However, there is a problem that the NRD guide and the microstrip line cannot be efficiently coupled.

In view of the above-described problems, it is an object of the present invention to provide an NRD guide transition capable of realizing, with a low loss, a hybrid structure in which an NRD guide is used for a transmission part and a microstrip line is used for a circuit element loading part, and provide a coupling structure of a dielectric material and a conductor capable of assuredly obtaining designed transmission characteristics with a simple configuration.

SUMMARY OF THE INVENTION

To this end, an NRD guide transition according to the present invention is characterized by comprising: a dielectric waveguide which is sandwiched between parallel conductor plates and has a height which is less than a ½ wavelength; a microstrip line which is provided on a side surface of a conductor rod opposite to the dielectric waveguide, the conductor rod being adjacently arranged in substantially parallel with the dielectric waveguide; and a coaxial line which pierces the conductor rod and connects the dielectric waveguide with the microstrip line.

Further, an NRD guide transition according to the present invention is characterized by comprising: a first dielectric waveguide which is sandwiched between parallel conductor plates and has a height which is less than a ½ wavelength; a second dielectric waveguide which is cascade arranged with respect to the first dielectric waveguide in a longitudinal direction; a microstrip line which is provided on a side surface of a conductor rod opposite to the first and second dielectric waveguides, the conductor rod being adjacently arranged in substantially parallel with the first and second dielectric waveguides; a first coaxial line which pierces the conductor rod in the vicinity of one end portion thereof, and connects the first dielectric waveguide with the vicinity of one end portion of the microstrip line; and a second coaxial line which pierces the conductor rod in the vicinity of the other end portion thereof, and connects the second dielectric waveguide with the vicinity of the other end portion of the microstrip line, wherein the first dielectric waveguide, the microstrip line and the second dielectric waveguide are cascade-connected.

Furthermore, an NRD guide transition according to present invention is characterized by comprising: first and second dielectric waveguides each of which is sandwiched between parallel conductor plates and has a height which is less than a ½ wavelength; first and second conductor rods which are provided between the first and second dielectric waveguides and arranged substantially parallel with the first and second dielectric waveguides; a microstrip line provided between the first and second conductor rods; a first coaxial line which pierces the first conductor rod and connects the first dielectric waveguide with one end of the microstrip line; and a second coaxial line which pierces the second conductor rod and connects the second dielectric waveguide with the other end of the microstrip line, wherein the first dielectric waveguide, the microstrip line and the second dielectric waveguide are cascade-connected.

Moreover, in the above-described invention, the NRD guide transition according to the present invention is characterized by further comprising: a first vertical strip line which connects one end of the first coaxial line connected with the first dielectric waveguide to the first dielectric waveguide; and a second vertical strip line which connects one end of the second coaxial line connected with the second dielectric waveguide to the second dielectric waveguide.

Additionally, in the above-described invention, the NRD guide transition according to the present invention is characterized in that the first conductor rod and the second conductor rod each have a ¼ wavelength choke structure formed on upper and lower surfaces thereof.

Further, in the above-described invention, the NRD guide transition according to the present invention is characterized in that a liquid dielectric material is filled on contact surfaces of the first and second coaxial lines and the microstrip line.

Furthermore, in the above described invention, the NRD guide transition according to the present invention is characterized in that the liquid dielectric material is a liquid dielectric material having dry curing properties.

Moreover, in the above-described invention, the NRD guide transition according to the present invention is characterized in that the liquid dielectric material having dry curing properties is enamel.

Additionally, in the above-described invention, a coupling structure of a dielectric material and a conductor according to the present invention is characterized in that, in the coupling structure of a dielectric material and a conductor in which an inner conductor of a coaxial line pierces a dielectric substrate of a microstrip line and the microstrip line is coupled with the coaxial line, a liquid dielectric material is filled on contact surfaces of the inner conductor and the dielectric substrate. Further, a coupling structure of a dielectric material and a conductor according to the present invention is characterized in that a conductor is arranged to be appressed against a dielectric waveguide of an NRD guide, and a liquid dielectric material is filled between the dielectric waveguide and the conductor, the dielectric waveguide being sandwiched between parallel conductor plates and having a gap which is less than a ½ wavelength, the NRD guide propagating a millimeter wave through the dielectric waveguide.

Furthermore, in the above described invention, the coupling structure of a dielectric material and a conductor according to the present invention is characterized in that the liquid dielectric material is a liquid dielectric material having dry curing properties.

Moreover, in the above-described invention, the coupling structure of a dielectric material and a conductor is characterized in that the liquid dielectric material having dry curing properties is enamel.

BEST MODE FOR CARRYING OUT THE INVENTION

Preferred embodiments of an NRD guide transition and a coupling structure of a dielectric material and a conductor according to the present invention will now be described in detail hereinafter with reference to the accompanying drawings.

Embodiment 1

Figure 1:
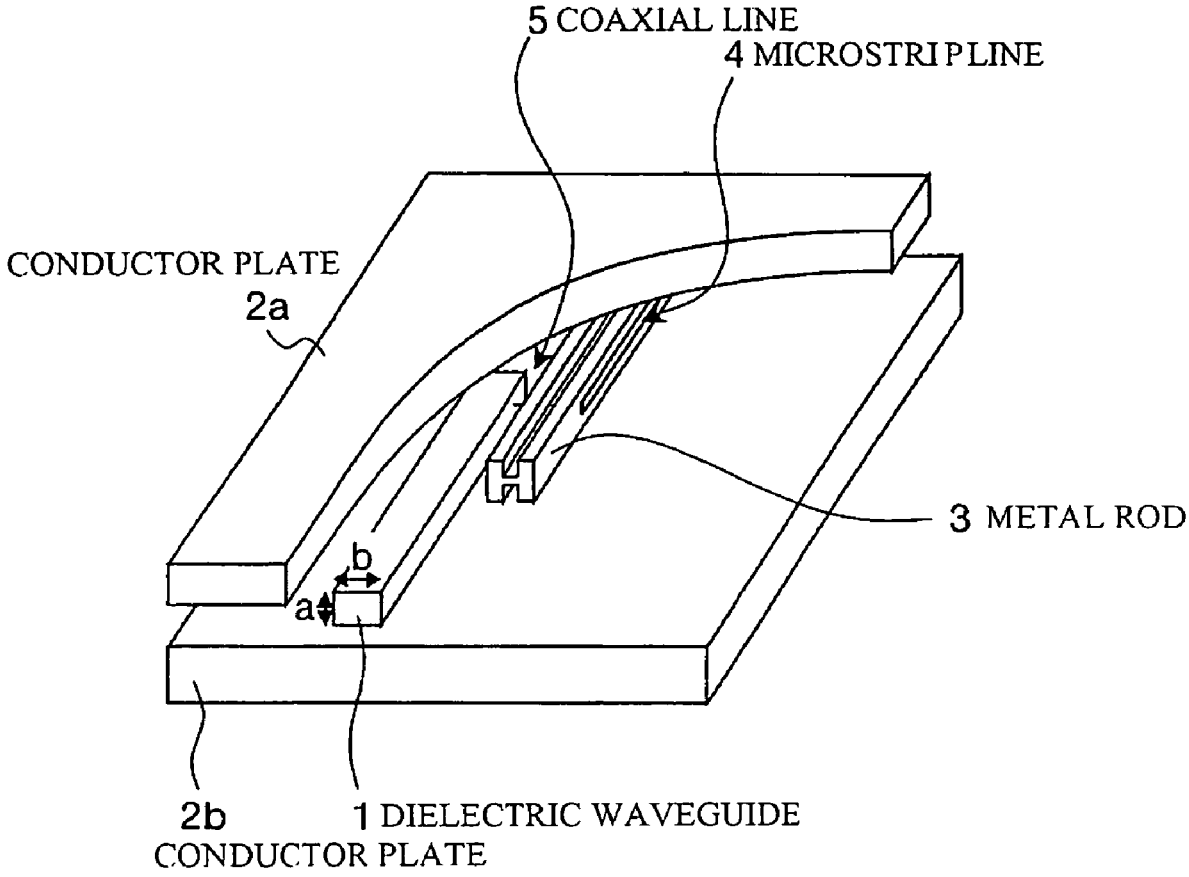
FIG. 1 is a partially cutaway perspective view showing an NRD guide transition according to Embodiment 1 of the present invention.

FIG. 1 is a partially cutaway perspective view showing an NRD guide transition according to Embodiment 1 of the present invention. In FIG. 1, this NRD guide transition has a dielectric waveguide 1 sandwiched between parallel conductor plates 2*a* and 2*b*, and a metal rod 3 as a conductor, which is arranged in close proximity to and parallel with this dielectric waveguide 1. A microstrip line 4 is formed on a side surface of this metal rod 3 opposite to the dielectric waveguide 1 side. Since a coaxial line 5 can be readily connected with the dielectric waveguide 1 and also easily connected with the microstrip line 4, the dielectric waveguide 1 is connected with the microstrip line 4 through the coaxial line 5. It is to be noted that the metal rod 3 is sandwiched between the conductor plates 2*a* and 2*b* like the dielectric waveguide 1. Further, the dielectric waveguide 1 is realized by TEFLON® having a relative dielectric constant $\in r=2.04$, tan $\delta$=approximately $1.5\times10^{-4}$, and has a height a of 2.25 mm and a width b of 2.5 mm. Assuming that an operating frequency of a millimeter wave propagated through the dielectric waveguide 1 is 60 GHz, its wavelength $\lambda$ is approximately 5 mm, the height a becomes not smaller than a ½ wavelength, and a millimeter wave having the operating frequency is not propagated between the conductor plates 2*a* and 2*b* outside of the dielectric waveguide 1. In the dielectric waveguide 1, however, a wavelength is reduced, and the millimeter wave having the operating frequency can be propagated. As a result, there is formed an NRD guide in which the millimeter wave is propagated only through the dielectric waveguide 1 in the operating frequency band.

Figure 2:
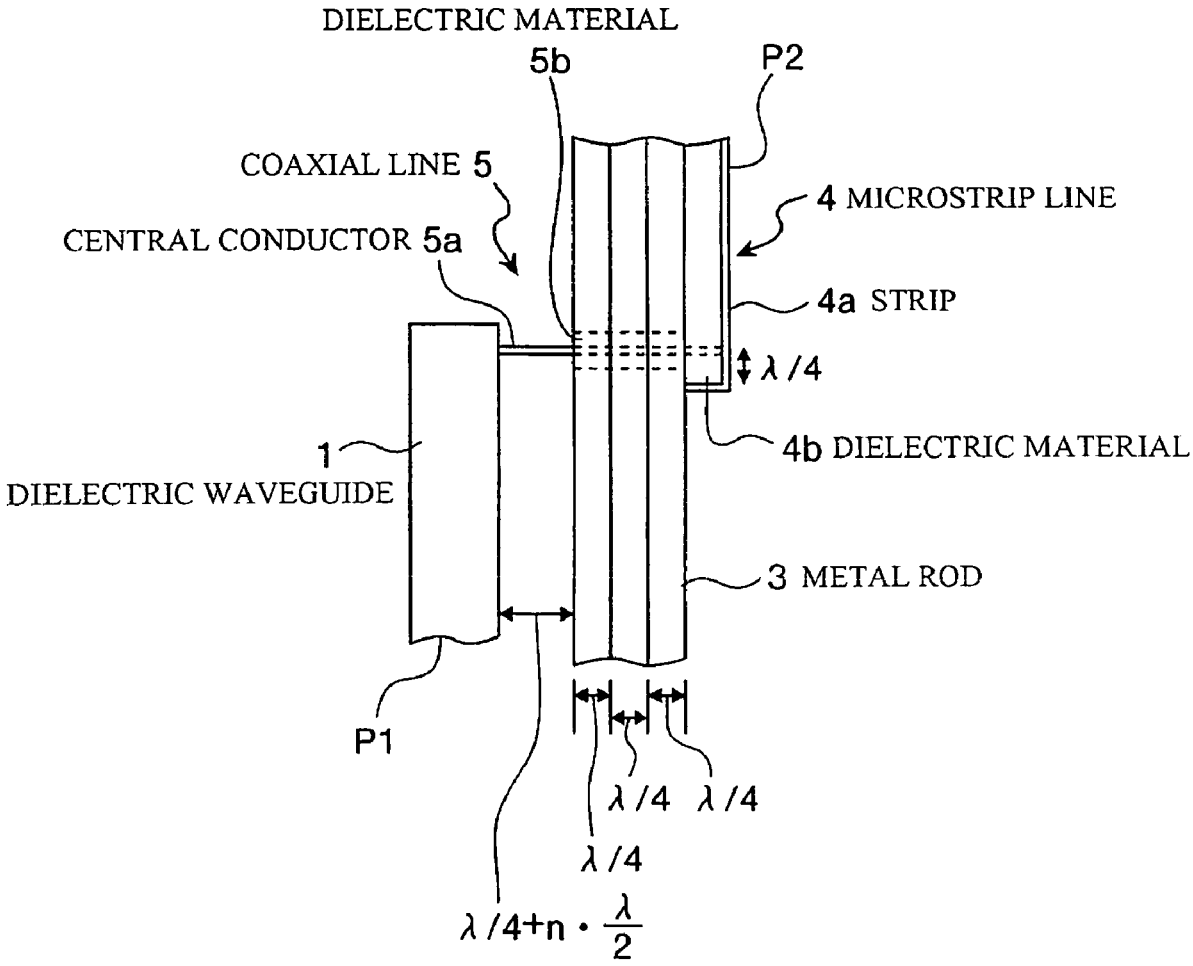
FIG. 2 is a plan view showing a primary part of the NRD guide transition depicted in FIG. 1.

Here, a configuration in the vicinity of the coaxial line 5 will now be described with reference to FIG. 2. In FIG. 2, a cylindrical hole is provided in the metal rod 3, a dielectric material 5*b*, realized by TEFLON® or the like, is filled in this hole, and a central conductor 5*a* pierces through an axis of this dielectric material 5*b*, thereby forming the coaxial line 5. One end of the central conductor 5*a* on the dielectric waveguide 1 side is coupled in a state where it is press-bonded on a side surface of the dielectric waveguide 1, and the other end of the central conductor 5*a* on a strip 4*a* side is connected with a strip 4*a*.

A dielectric material 4*b* is provided on the metal rod 3, and the strip 4*a* having a strip shape is formed on this dielectric material 4*b*, thereby realizing the microstrip line 4. The microstrip line 4 is realized by the dielectric material 4*b* having, e.g., a substrate thickness of 0.2 mm and a relative dielectric constant $\in r=2.3$ and the strip 4*a* having a line width of 0.5 mm. The strip 4*a* is grounded with respect to the metal rod 3 at a position which is $\lambda/4$ away from a coupling point between itself and the central conductor 5*a*.

A length of the central conductor 5*a* between the metal rod 3 and the dielectric waveguide 1 can be set to, e.g., $\lambda/4$, and it may be generally set to $\lambda/4+n\cdot(\lambda/2)$. It is to be noted that n is 0, 1, 2, . . . , i.e., an integer including 0. Furthermore, the metal rod 3 has an H cross-sectional shape, a length of each side thereof in a direction of the central conductor 5*a* is set to a ¼ wavelength, and the metal rod 3 has a choke structure which prevents an electric wave in an operating frequency band between the dielectric waveguide 1 side and the microstrip line 4 side from leaking.

Figure 3:
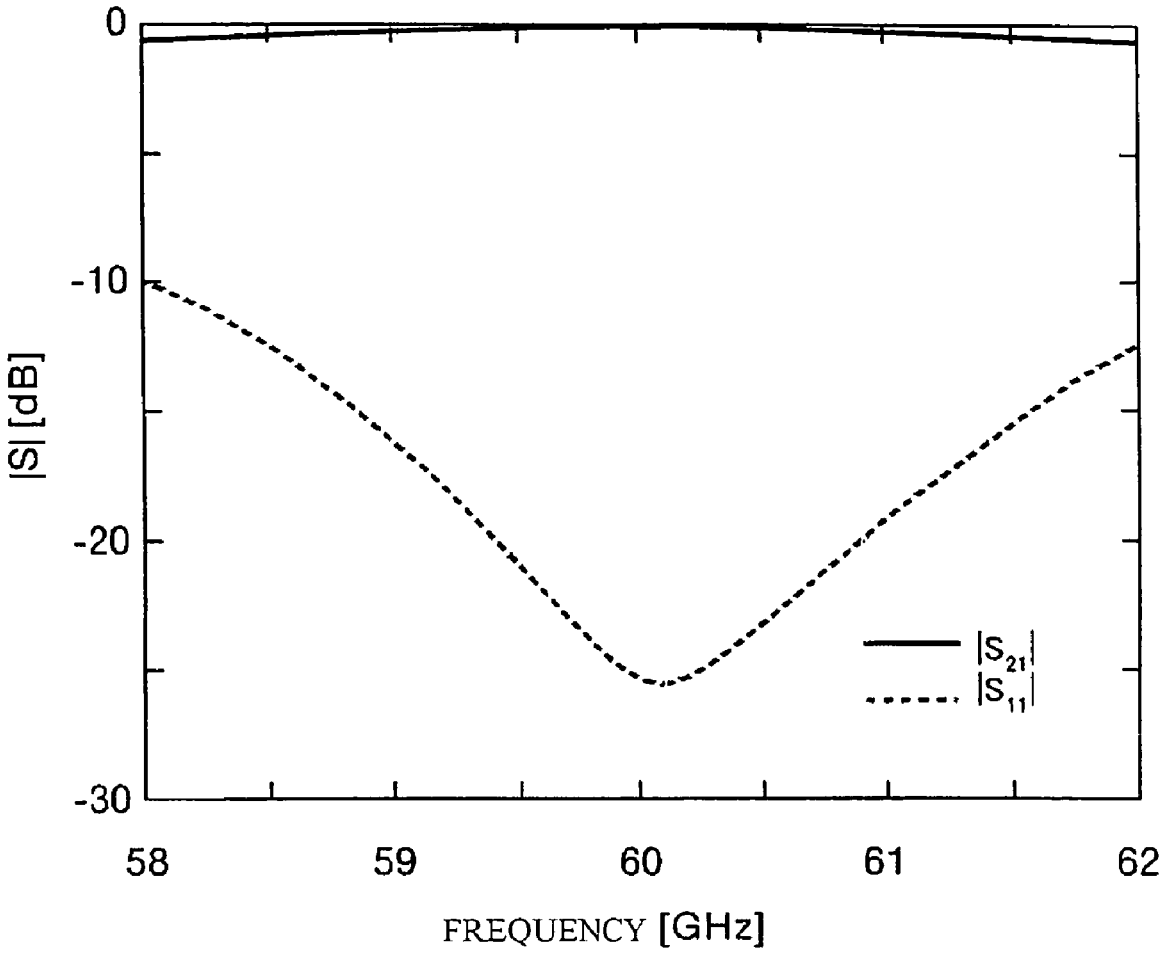
FIG. 3 is a view showing frequency characteristics of a transition output and a return loss of the NRD guide transition depicted in FIG. 1.

FIG. 3 is a view showing frequency characteristics (in GHz) of an output $|S_{21}|$ of a power (expressed in units of dB), input from a port P1 to a port P2 of the NRD guide transition as depicted in FIG. 2 and a return loss $|S_{11}|$ at the port P1. As shown in FIG. 3, the return loss $|S_{11}|$ is not greater than 20 dB in a 2-GHz band with 60 GHz at the center, and the output $|S_{21}|$ from the dielectric waveguide 1 to the microstrip line 4 through the coaxial line 5 is an efficient transition output. That is, a transition between the dielectric waveguide 1 and the microstrip line 4, which can satisfactorily come into practical use, is realized.

Embodiment 2

Embodiment 2 according to the present invention will now be described. Although one dielectric waveguide 1 and one microstrip line 4 are coupled with each other in Embodiment 1 mentioned above, a dielectric waveguide is coupled with each of both ends of a microstrip line in this Embodiment 2.

Figure 4:
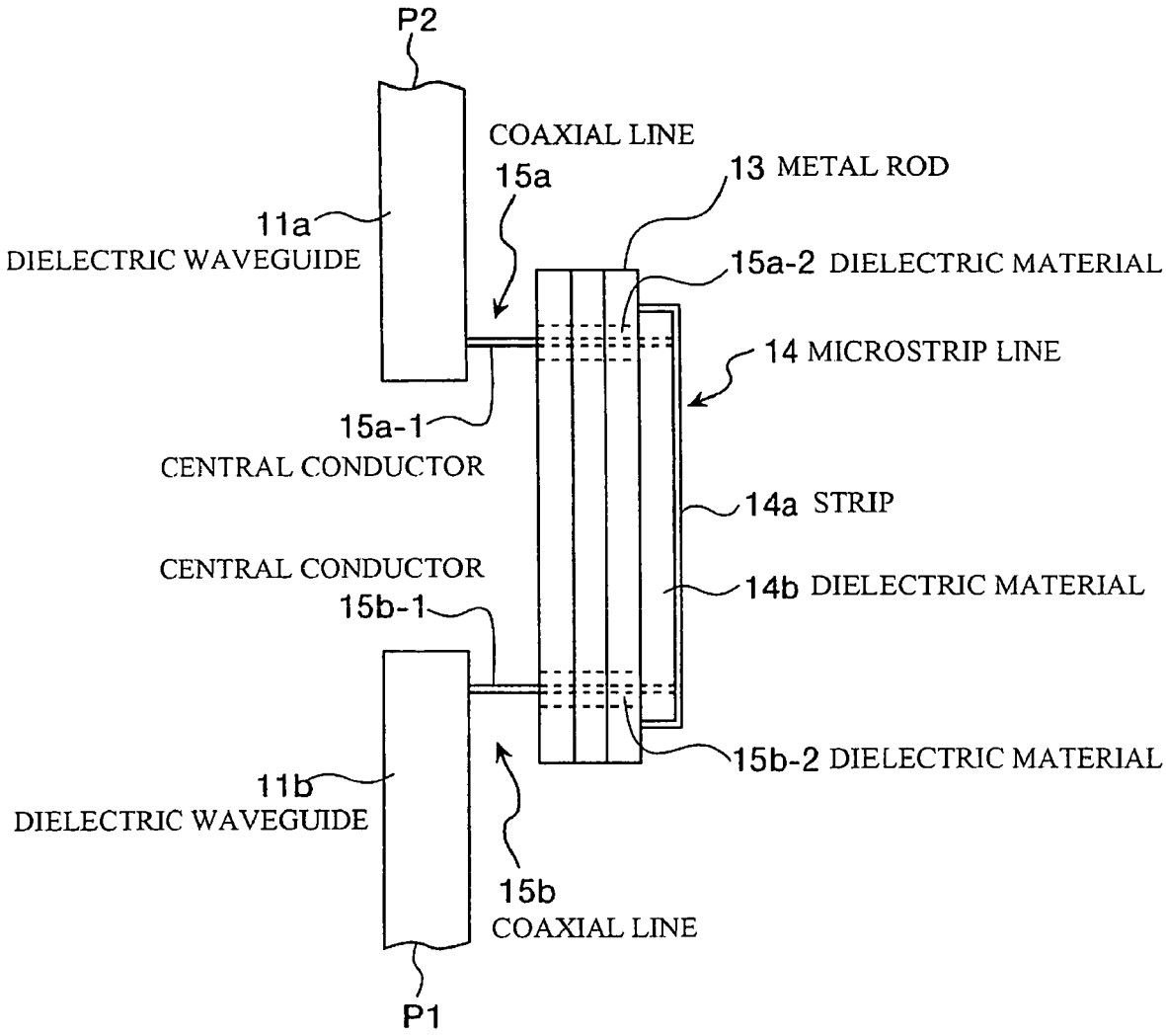
FIG. 4 is a plan view showing a primary part of an NRD guide transition according to Embodiment 2 of the present invention.

FIG. 4 is a plan view showing a primary part of an NRD guide transition according to Embodiment 2 of the present invention. As shown in FIG. 4, coaxial lines 15*a* and 15*b* corresponding to the coaxial line 5 are formed at both ends of a strip 14*a* of a microstrip line 14, and they are respectively connected with dielectric waveguides 11*a* and 11*b*. It is to be noted that metal rod 13 corresponds to metal rod 3 of FIG. 2, central conductors 15*a*-1 and 15*b*-1 correspond to the central conductor 5*a* of FIG. 2, a dielectric material 14*b* corresponds to the dielectric material 4*b* of FIG. 2, and dielectric materials 15*a*-2 and 15*b*-2 correspond to the dielectric material 5*b* of FIG. 2.

Figure 5:
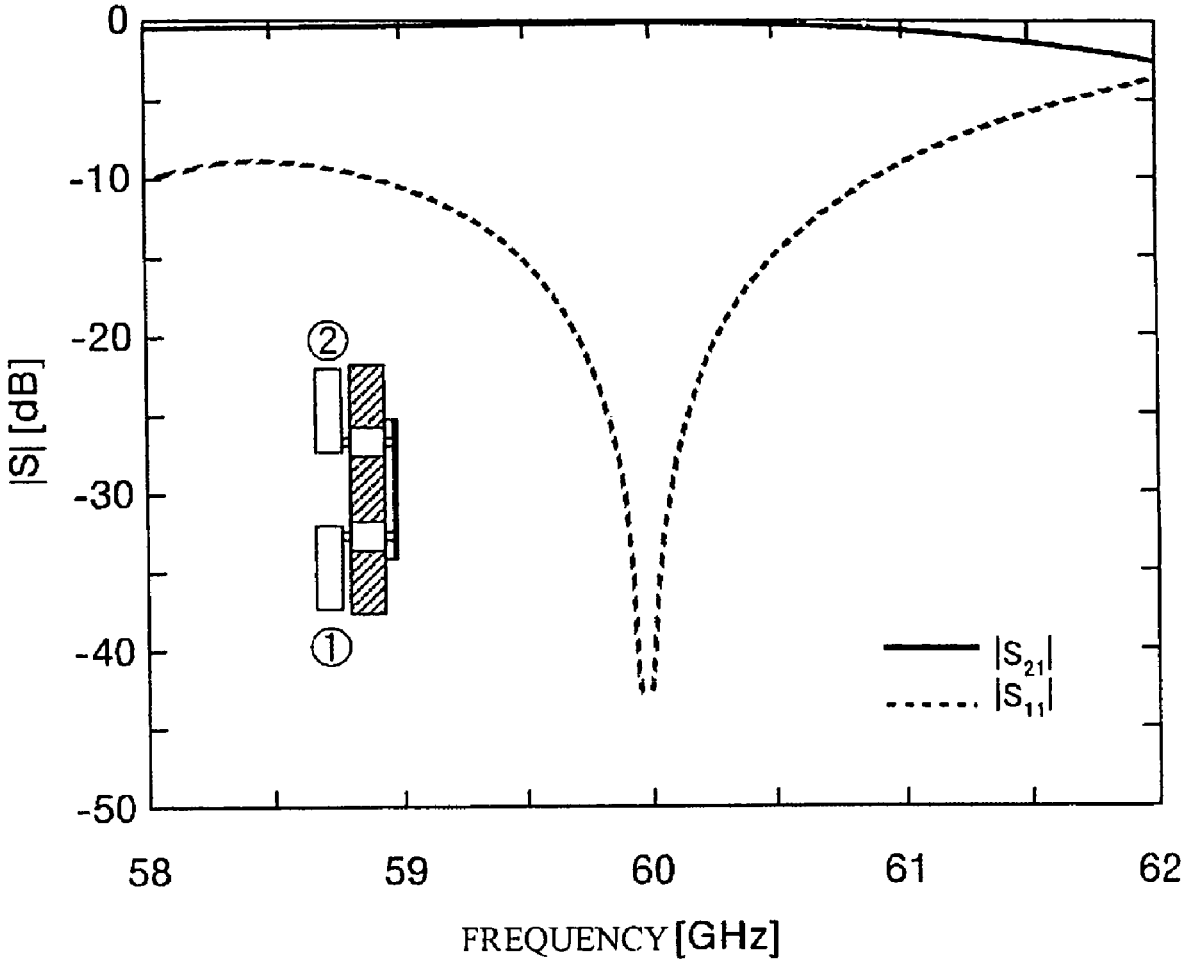
FIG. 5 is a view showing frequency characteristics of a transition output and a return loss of the NRD guide transition depicted in FIG. 4.

FIG. 5 is a view showing frequency characteristics (in GHz) of an output $|S_{21}|$ of a power (expressed in units of dB) input from a port P1 to a port P2 and a return loss $|S_{11}|$ at the port P1 of the NRD guide transition depicted in FIG. 4. It is to be noted that the port P1 is a port on the dielectric waveguide 11*b* side, and the port P2 is a port on the dielectric waveguide 11*a* side. As shown in FIG. 5, the return loss $|S_{11}|$ is not greater than approximately 10 dB in a 2 GHz band with 60 GHz at the center, and the output $|S_{21}|$ from the dielectric waveguide 11*b* to the dielectric waveguide 11*a* through the coaxial line 15*b*, the microstrip line 14 and the coaxial line 15*a* is an efficient conversion output.

In this Embodiment 2, the microstrip line 14 can be used as a mount of a three-terminal device.

Embodiment 3

Although the side surface of the metal rod 3 or 13 is effectively utilized and the microstrip line 4 or 14 is provided on this side surface in order to effectively use a space formed between the conductor plates 2*a* and 2*b* in the above-described Embodiments 1 and 2, an NRD guide transition which can obtain a larger loading surface is realized in this Embodiment 3.

Figure 6:
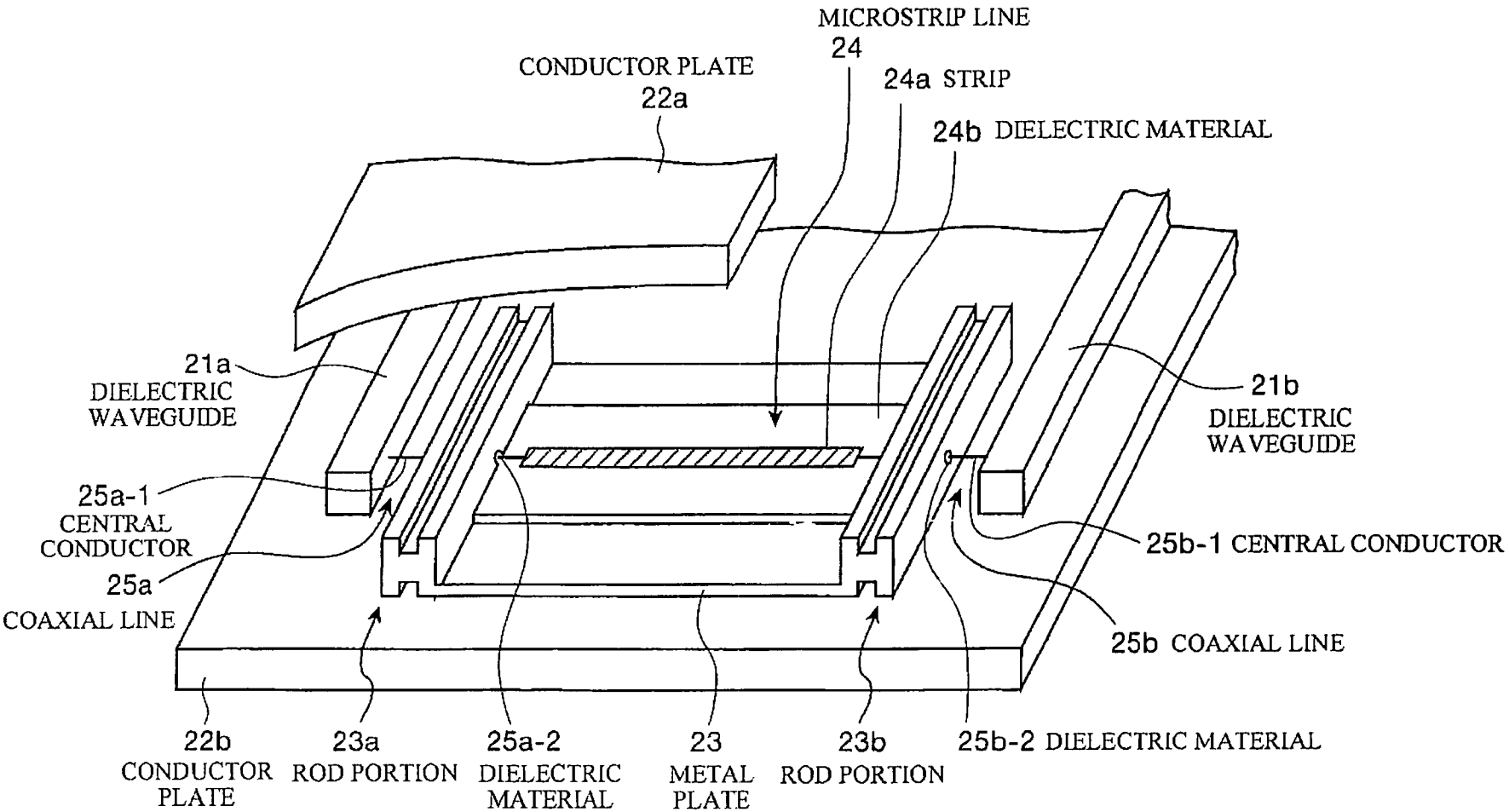
FIG. 6 is a partially cutaway perspective view of an NRD guide transition according to Embodiment 3 of the present invention.

FIG. 6 is a partially cutaway perspective view showing an NRD guide transition according to Embodiment 3 of the present invention. In FIG. 6, this NRD guide transition has two dielectric waveguides 21*a* and 21*b* held between conductor plates 22*a* and 22*b*, and these dielectric waveguides correspond to the dielectric waveguides 1 (FIGS. 1 and 2), and 11*a* and 11*b* (FIG. 4). A metal plate 23 having rod portions 23*a* and 23*b* corresponding to the metal rods 3 and 13 is provided between the dielectric waveguides 21*a* and 21*b*. Further, a dielectric material 24*b* is formed on a concave portion at the center of the metal plate 23, and a strip 24*a* is further provided thereon. That is, the central concave portion, the dielectric material 24*b* and the strip 24*a* form a microstrip line 24.

Dielectric materials 25*a*-2 and 25*b*-2 corresponding to the dielectric material 5*b* (FIG. 2) are provided at the center of the rod portions 23*a* and 23*b*, and central conductors 25*a*-1 and 25*b*-1 corresponding to the central conductor 5*a* (FIG. 2) are provided so as to pierce the dielectric materials 25*a*-2 and 25*b*-2. The central conductors 25*a*-1 and 25*b*-1 are connected with both ends of the strip 24*a* and also pressure-bonded on side surfaces of the dielectric waveguides 21*a* and 21*b*, respectively. That is, the dielectric waveguides 21*a* and 21*b* are coupled and connected with the microstrip line 24 through coaxial lines 25*a* and 25*b* corresponding to the coaxial line 5 (FIG. 2).

Here, since the central concave portion of the metal plate 23 forms a plane parallel with the conductor plates 22*a* and 22*b*, the microstrip line 24 having a large loading area can be formed. That is, the NRD guide transition according to this Embodiment 3 can be used for the microstrip line 24, which requires a large circuit area.

Figure 7:
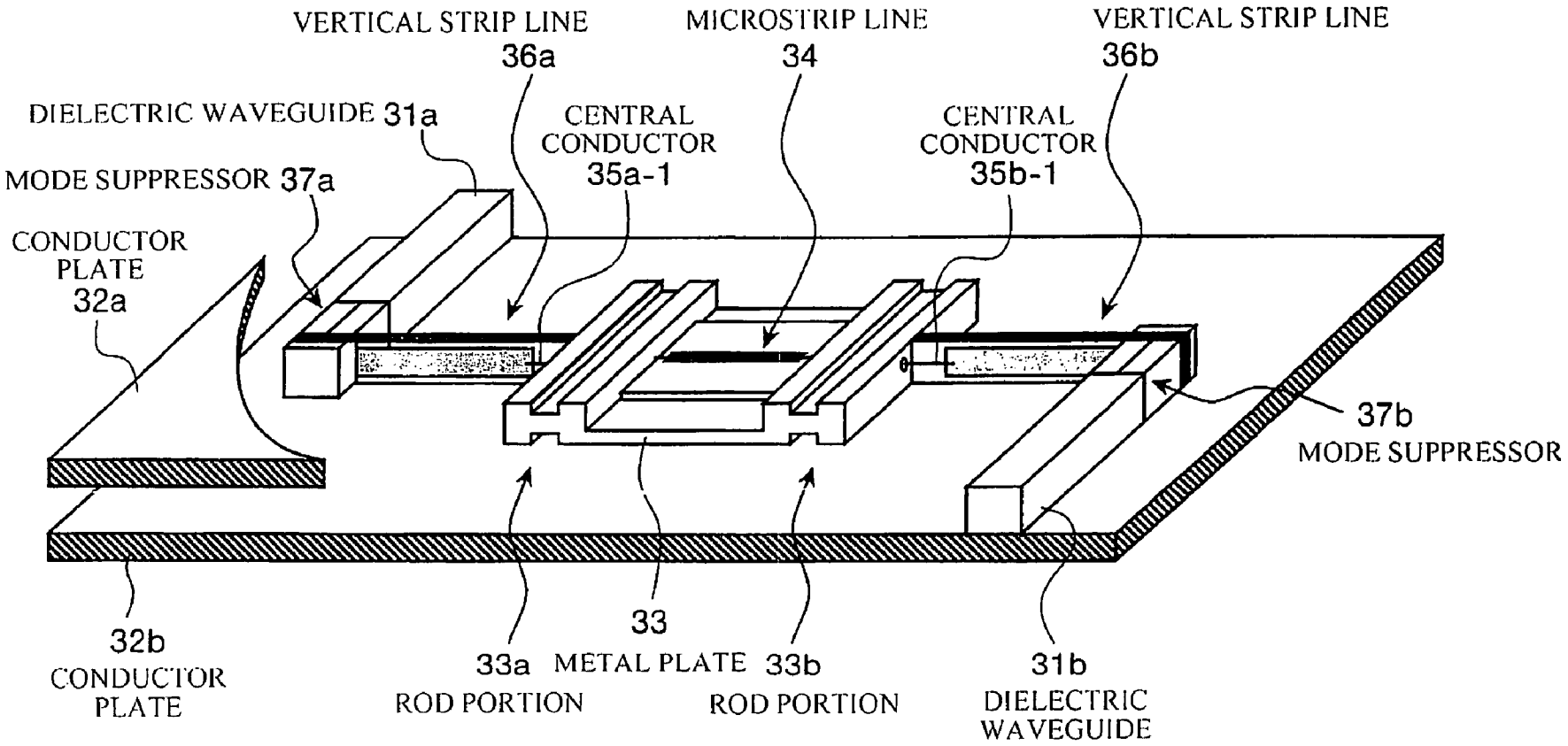
FIG. 7 is a partially cutaway perspective view showing a modification of the NRD guide transition according to Embodiment 3 of the present invention.

FIG. 7 is a partially cutaway perspective view showing a modification of the NRD guide transition depicted in FIG. 6. In FIG. 7, the conductor plate 32*a*, the conductor plate 32*b*, the metal plate 33, the rod portion 33*a*, the rod portion 33*b*, and the microstrip line 34 correspond to the conductor plate 22*a*, the conductor plate 22*b*, the metal plate 23, the rod portion 23*a*, the rod portion 23*b*, and the microstrip line 24, respectively, of FIG. 6. In this NRD guide transition, central conductors 35*a*-1 and 35*b*-1 are not directly connected with dielectric waveguides 31*a* and 31*b*, but vertical strip lines 36*a* and 36*b* are interposed to connect these members. Interposition of these vertical strip lines 36*a* and 36*b* provide mode suppressors 37*a* and 37*b*, which suppress an LSE mode which is an unnecessary parasitic mode at coupling parts of the dielectric waveguides 31*a* and 31*b*. The vertical strip lines 36*a* and 36*b* physically set the dielectric waveguides 31*a* and 31*b* apart from rod portions 33*a* and 33*b*, to thereby reduce an influence of an operating mode electric wave on the dielectric waveguides 31*a* and 31*b* from the vicinity of the coupling parts, and couple the dielectric waveguides 31*a* and 31*b* with the central conductors 35*a*-1 and 35*b*-1 with a low loss.

In this Embodiment 3, formation of the microstrip line requiring a large loading area can be realized with a low loss.

As described above, according to the present invention, there can be obtained an effect of readily realizing a hybrid structure in which the dielectric waveguides having a very low loss can be connected with the microstrip line capable of realizing a flexible circuit configuration through the coaxial lines piercing the conductor rods, the dielectric waveguides are used for the transmission parts and the microstrip line is used for the circuit element loading part.

Furthermore, according to the present invention, since the first dielectric waveguide, the microstrip line and the second dielectric waveguide are cascade-connected, there can be obtained an effect of realizing a hybrid structure in which a three-terminal circuit can be loaded on the microstrip line.

Moreover, according to the present invention, there can be obtained an effect of realizing a hybrid structure in which the microstrip line is provided between the first and second conductor rods and the microstrip line which forms a plane parallel with the parallel conductor plates and has a large loading area is mounted, for example.

Additionally, the present invention can demonstrate an effect of realizing a hybrid structure in which the first and second vertical strip lines respectively set the first and second conductor rods apart from the first and second dielectric waveguides, thereby reducing disturbances of an electric wave with respect to the first and second dielectric waveguides.

Further, according to the present invention, there can be obtained an effect of realizing a high-performance hybrid structure since the dielectric waveguide side is electrically separated from the microstrip side.

Embodiment 4

Embodiment 4 according to the present invention will now be described. In this Embodiment 4, a description will be given on an example where a microstrip line is coupled with a coaxial line. In particular, this Embodiment 4 can be applied to Embodiment 1 or the like mentioned above to prevent a transmission loss from being further deteriorated.

Figure 8:
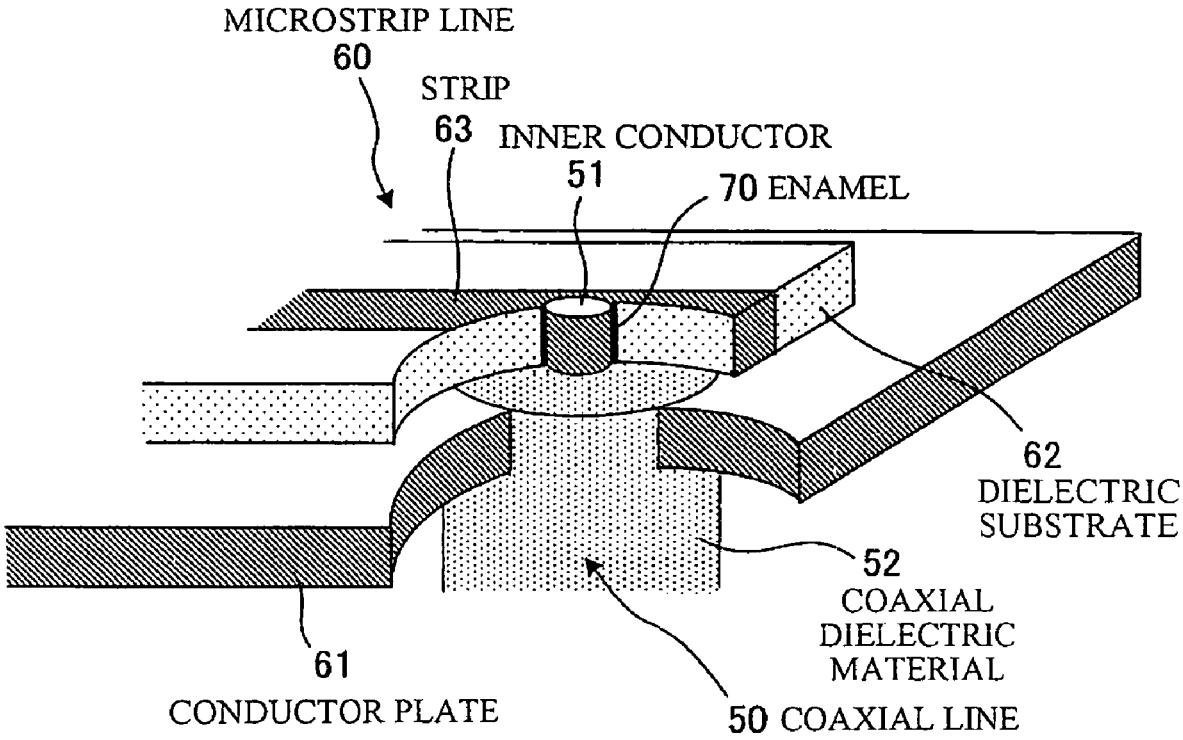
FIG. 8 is a partially cutaway view obliquely showing a coupling structure of a microstrip line and a coaxial line according to Embodiment 4 of the present invention.

FIG. 8 is a partially cutaway view obliquely showing a coupling structure of a microstrip line and a coaxial line according to Embodiment 4 of the present invention. As shown in FIG. 8, in a microstrip line 60, a strip 63 is formed on a conductor plate 61 through a dielectric substrate 62. In a coaxial line 50 coupled with this microstrip line 63, a coaxial dielectric material 52 pierces the conductor plate, and an inner conductor 51 in the coaxial dielectric material 52 further pierces the dielectric substrate 62 to be coupled with a strip 63. In this case, the conductor plate 61 functions as an external conductor.

Figure 9:
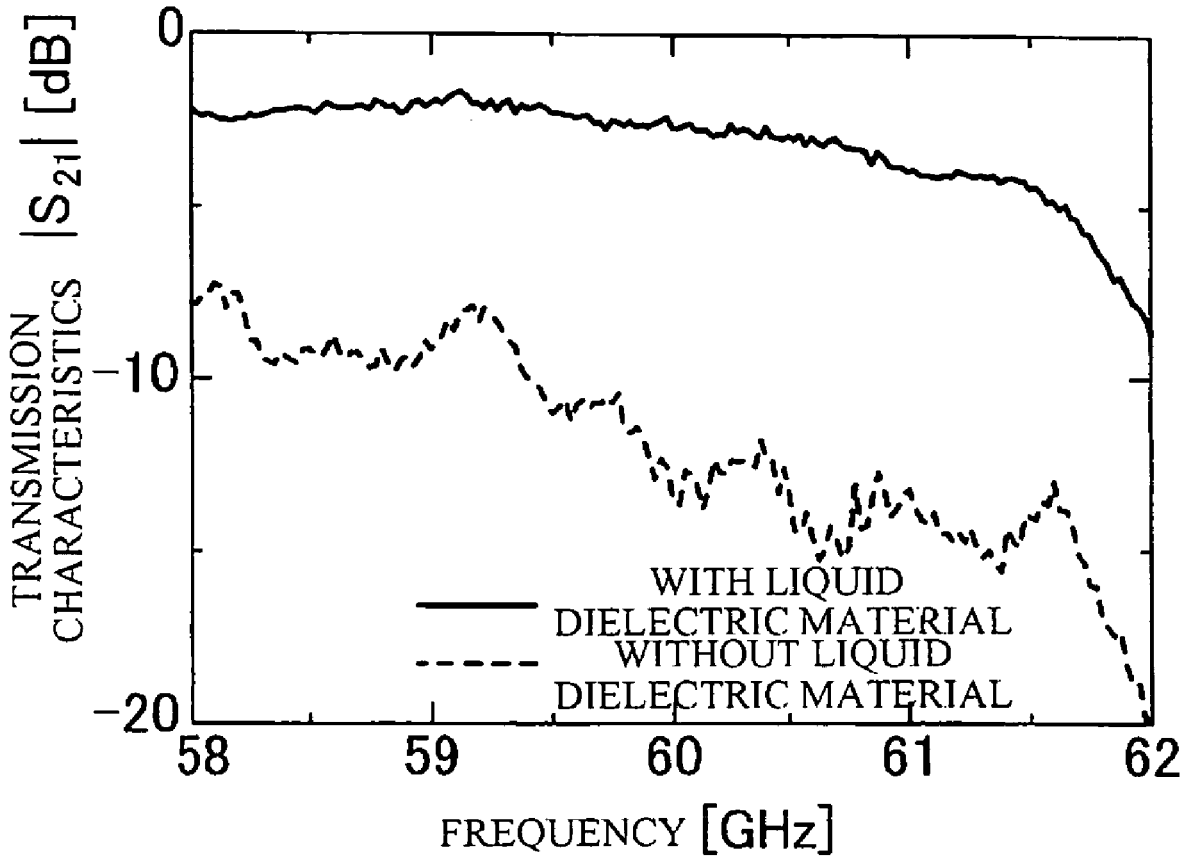
FIG. 9 is a view showing a difference in transmission characteristics depending on the presence/absence of enamel filling.

It is difficult to form a structure which does not have any air gap between the inner conductor 51 and the dielectric substrate 62. As depicted in FIG. 9, showing a difference in transmission characteristics depending on the presence or absence of enamel filling, transmission characteristics (as expressed in units dB of transmission power $|S_{21}|$ with respect to frequency) are deteriorated where liquid dielectric material is absent, as indicated by a broken line in FIG. 9. Thus, when enamel 70 is filled in order to completely eliminate the air gap between the inner conductor 51 and the dielectric substrate 62, the characteristics can be improved 5 dB or more as indicated by a solid line in FIG. 9.

Filling the air gap generated at a position where an electromagnetic field distribution is intensive in this manner can assuredly obtain the designed characteristics as the transmission characteristics. It is to be noted that the transmission characteristics indicated by a solid line demonstrates a loss of approximately 2 dB even though the enamel 70 is filled, but this loss is not a loss caused due to transition between the microstrip line 60 and the coaxial line 50 but a transmission loss of the microstrip line 60 itself.

According to this Embodiment 4, even if the microstrip line 60 and the coaxial line 50 are simply coupled with each other, the air gap produced between the dielectric substrate 62 and the inner conductor 51 at which an electromagnetic field is concentrated can be filled with the enamel 70 to thereby eliminate deterioration in the transmission characteristics.

Embodiment 5

This embodiment 5 is obtained by applying the method of filling a liquid dielectric material according to Embodiment 4 to an NRD guide mode suppressor.

Figure 10:
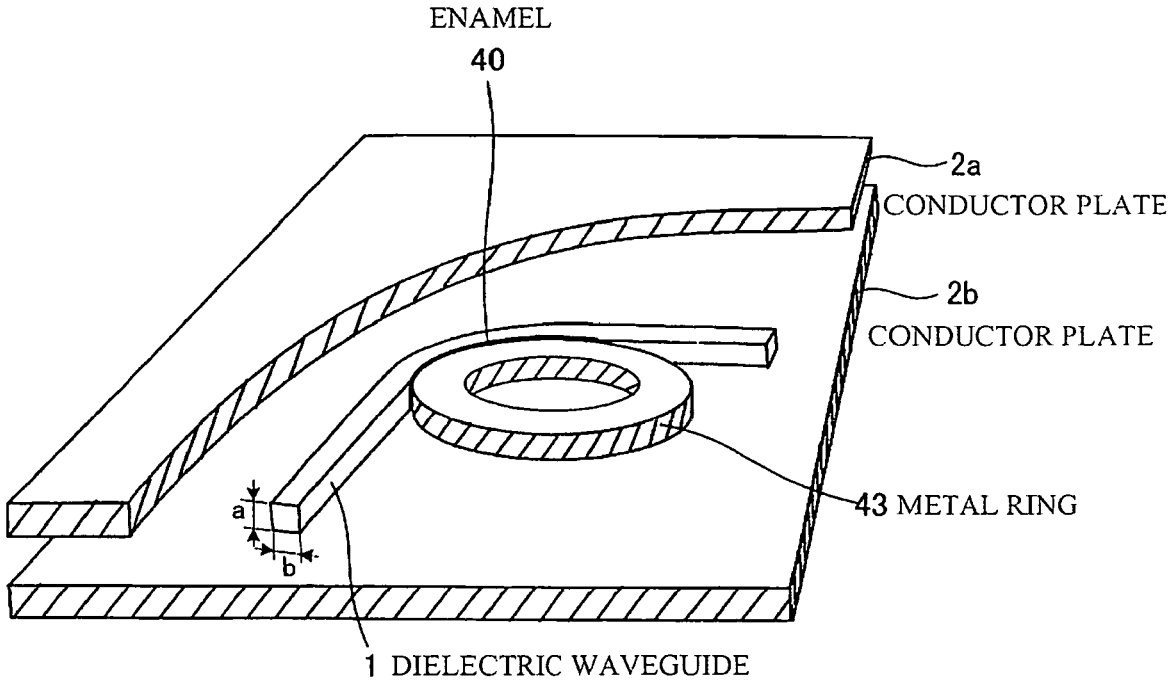
FIG. 10 is a partially cutaway view obliquely showing a general configuration of an NRD guide mode suppressor according to Embodiment 5 of the present invention.

FIG. 10 is a partially cutaway view obliquely showing a general configuration of an NRD guide mode suppressor according to Embodiment 5 of the present invention. In FIG. 10, this NRD guide mode suppressor has a dielectric waveguide 1 sandwiched between parallel conductor plates 2*a* and 2*b*. The dielectric waveguide 1 is realized by using TEFLON® having a relative dielectric constant $\in r=2.04$ and tan $\delta$=approximately $1.5\times10^{-4}$, and has a height of 2.25 mm and a width b of 2.5 mm. Assuming that an operating frequency of an electromagnetic wave propagated through the dielectric waveguide 1 is 60 GHz, its wavelength $\lambda$ is approximately 5 mm, its height a is less than $\lambda/2$, and a millimeter wave having the operating frequency is not propagated between the conductor plates 2*a* and 2*b* outside of the dielectric waveguide 1. In the dielectric waveguide 1, however, the wavelength $\lambda$ is reduced, and only the millimeter wave having the operating frequency can be propagated. As a result, it is possible to form an NRD guide in which the millimeter wave can be propagated through the dielectric waveguide 1 alone in an operating frequency band.

Figure 11:
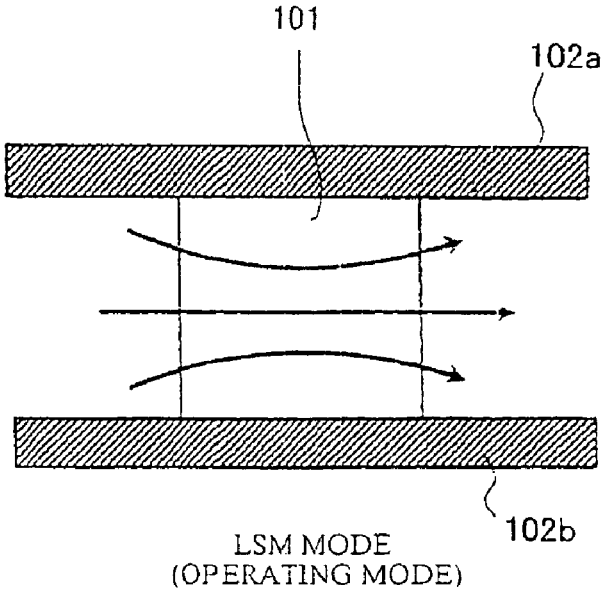
FIG.11 (PRIOR ART)
FIG. 11 is a view showing an electric field distribution of an operating mode.
Figure 12:
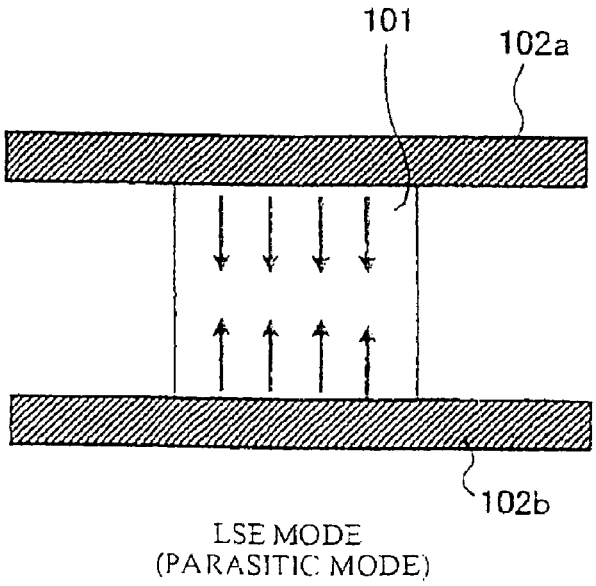
FIG.12 (PRIOR ART)
FIG. 12 is a view showing an electric field distribution of a parasitic mode.

Here, the dielectric waveguide 1 has a configuration which is bent with a curvature radius R=12 mm and, in this case, as shown in FIGS. 11 and 12, an LSE mode which is a parasitic mode is generated besides an LSM mode which is an operating mode. Here, when a metal ring 43, which is a conductor, is pressed against a bent inner side of the dielectric waveguide 1, the LSE mode is suppressed. In order to set this metal ring 43 to be pressed against the dielectric waveguide 1, enamel 40 as a liquid dielectric material having dry curing properties is filled between the metal ring 43 and the dielectric waveguide 1 to achieve close contact.

Figure 13:
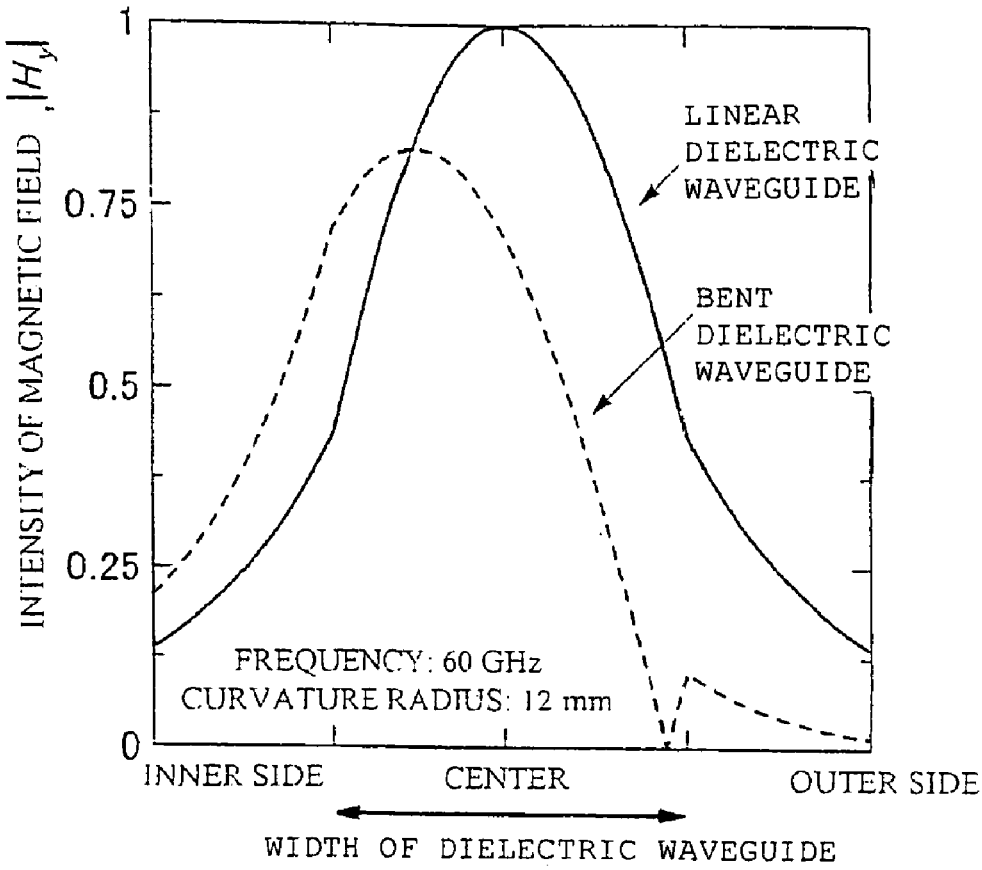
FIG. 13 is a view showing a change in an electromagnetic field distribution involved by bending of the NRD guide.
Figure 14:
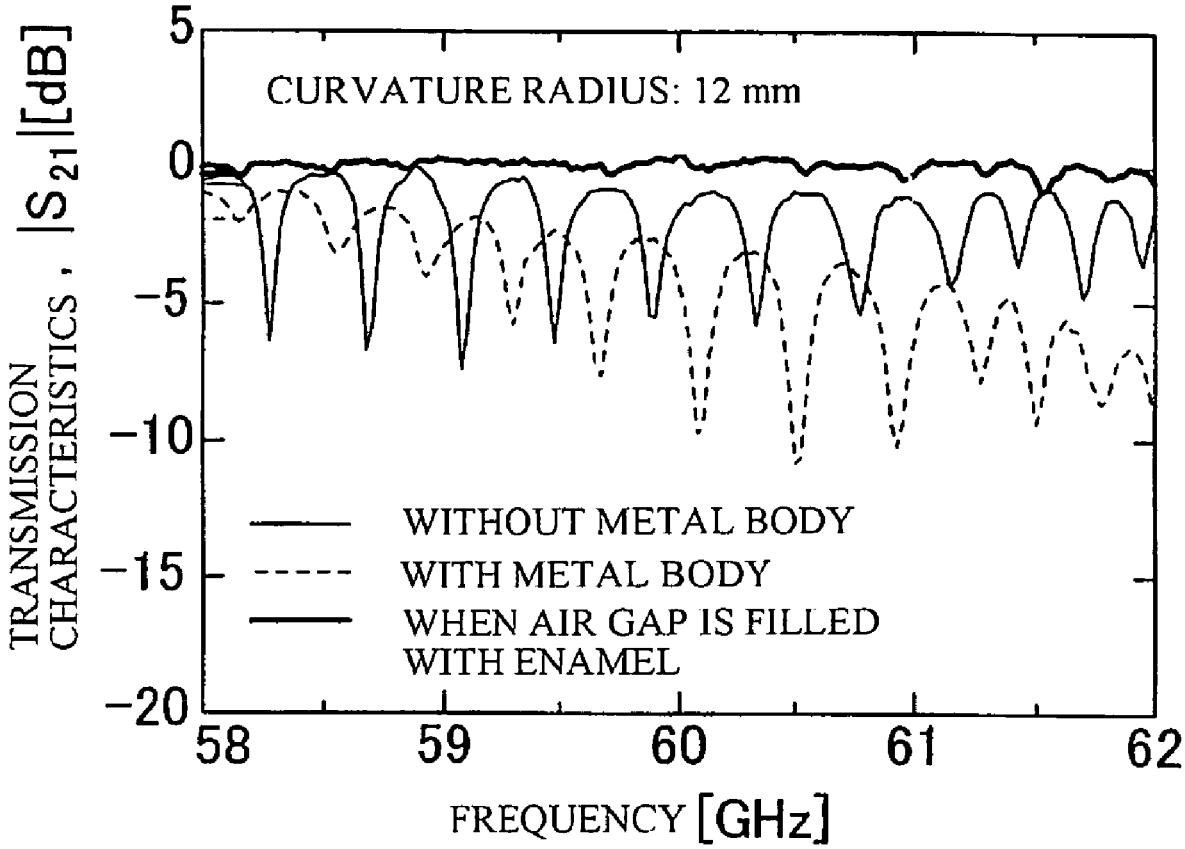
FIG. 14 is a view showing a difference in transmission characteristics depending on the presence/absence of enamel filling.
Figure 15:
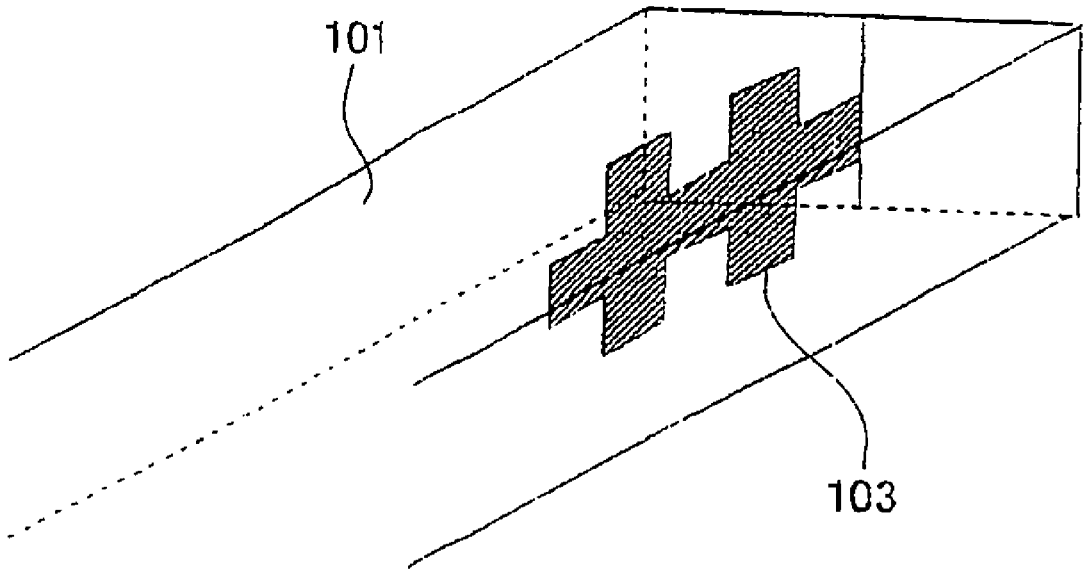
FIG.15 (PRIOR ART)
FIG. 15 is a schematic view showing a configuration of a conventional NRD guide mode suppressor.

As shown in FIG. 13, illustrating magnetic field strength with respect to a width across the dielectric waveguide when the dielectric waveguide 1 is bent as compared with an example where the dielectric waveguide 1 is straight or linear, an electromagnetic field is shifted toward a bent inner side, such that the electromagnetic field intensity on the bent inner side is increased. Here, as shown in FIG. 14, in terms of transmission power $|S_{21}|$ (in dB units) with respect to frequency, spike-like deterioration is generated due to an increase in the electromagnetic field intensity as well as the air gap produced between the dielectric waveguide 1 and the metal ring 43, but filling the enamel 40 can eliminate this spike like deterioration. That is, although design and manufacture are carried out so as not to produce the air gap between the dielectric waveguide 1 and the metal ring 43, removing existence of this small air gap is difficult, and filling the enamel 40 can eliminate an influence of this air gap.

According to this Embodiment 5, the air gap generated between the dielectric material 1 and the metal ring 43 can be removed by filling the air gap with enamel 40, whereby spike-like deterioration of transmission characteristics are eliminated. It is to be noted that the enamel 40 is the liquid dielectric material having dry curing properties, but the present invention is not restricted thereto, and any liquid dielectric material can suffice, and oil can also be used. However, a material having curing and adhesion properties like the enamel 40 is preferable.

It is to be noted that the description has been given as to coupling of the microstrip line and the coaxial line, and the example of the NRD guide suppressor in Embodiments 4 and 5, but the present invention is not restricted thereto, and it can be applied to all configurations which closely couple a dielectric material with a metal (conductor) to eliminate an air gap. For example, in FIG. 8, the present invention can be likewise applied between the dielectric substrate 62 and the conductor plate 61 to readily completely eliminate a gap, thereby demonstrating an effect in an improvement of transmission characteristics.

INDUSTRIAL APPLICABILITY

As described above, the NRD guide transition according to the present invention can readily realize a hybrid structure in which the dielectric waveguide having a very low loss is connected with the microstrip line capable of realizing a flexible circuit configuration through the coaxial line piercing the conductor rod, the dielectric waveguide is used for a transmission part and the microstrip line is used for a circuit element loading part, and hence the present invention can be applied to an ultrahigh-speed wireless LAN, a home link, indoor TV wireless transfer and an inter-vehicle communication system. Further, the coupling structure of the dielectric material and the conductor realized by filling the liquid dielectric material according to the present invention can be applied to all structures which sets the dielectric material to be appressed against the conductor in order to couple them with each other, and general communication devices which avoid deterioration of transmission characteristics in particular.

The invention claimed is:

1. An NRD guide transition, comprising:

two parallel conductors;

a dielectric waveguide sandwiched between the two parallel conductors, a first of the two parallel conductors being at a top of the dielectric waveguide, and a second of the two parallel conductors being at a bottom of the dielectric waveguide, and a height of the dielectric waveguide separating the two parallel conductors being less than a ½ wavelength of a wave to be propagated through the dielectric waveguide;

a conductor rod adjacent to and substantially parallel with the dielectric waveguide between the two conductors;

a microstrip line disposed on a dielectric material, the dielectric material being on a side surface of the conductor rod and the microstrip line disposed on a side of the dielectric material opposite to the dielectric waveguide, and a ground conductor for the microstrip line defined by the conductor rod; and a coaxial line, extending perpendicularly to a longitudinal direction of the conductor rod and parallel to the two parallel conductors, the coaxial line piercing the conductor rod and the dielectric material of the microstrip line such that the coaxial line connects the dielectric waveguide with the microstrip line.

2. The NRD guide transition according to claim 1, wherein a liquid dielectric material is filled in i) an air gap formed between contact surfaces of the dielectric material of the microstrip line and a cylindrical dielectric material of the coaxial line and ii) an air gap formed between the contact surfaces of the dielectric material of the microstrip line and the conductor rod.

3. The NRD guide transition according to claim 2, wherein the liquid dielectric material has dry curing properties.

4. The NRD guide transition according to claim 3, wherein the liquid dielectric material is enamel.

5. The NRD guide transition according to claim 1, wherein, a lateral width of a respective contact face of the conductor rod with respect to corresponding ones of the parallel conductor plates is a ¾ wavelength, and a groove having a width of a ¼ wavelength is provided at a central part of the contact face in a longitudinal direction to form a choke structure.

6. The NRD guide transition according to claim 1, wherein, the conductor rod comprises a first longitudinal portion, a second longitudinal portion, and a connecting longitudinal portion, the portions of the conductor rod forming a H-shaped cross-section, top surfaces of each of the first and second longitudinal portions in contact with the first of the two parallel conductors, bottom surfaces of each of the first and second longitudinal portions in contact with the second of the two parallel conductors, and the connecting longitudinal portion defining a groove between the first and second portions along the longitudinal direction of the conductor rod, the groove having a width of a ¼ wavelength of the wave to form a choke structure, a combined width of the first, second, and connecting portions of the conductor rod being a ¾ wavelength of the wave.

* * * * *